United States Patent [19]

Vignale

[11] 4,233,911

[45] Nov. 18, 1980

[54] SHOWER SHELF

[76] Inventor: Grace M. Vignale, Garden Rd., Rte. 5, Box 213-O, Deland, Fla. 32720

[21] Appl. No.: 32,838

[22] Filed: Apr. 24, 1979

[51] Int. Cl.[3] ..... A47B 41/04

[52] U.S. Cl. ..... 108/30; 211/88; 108/47; 248/214

[58] Field of Search ..... 248/214, 235; 211/88, 211/90; 108/16, 29, 152, 46, 47

[56] References Cited

U.S. PATENT DOCUMENTS

| | | | |
|---|---|---|---|
| 1,613,447 | 1/1927 | Ellberg | 108/29 X |
| 1,924,074 | 8/1933 | O'Halloran | 248/214 |
| 1,952,377 | 3/1934 | Lack | 108/47 |
| 2,092,234 | 9/1937 | Van Wert | 108/47 |
| 2,705,385 | 4/1955 | Markward | 248/214 X |
| 2,948,405 | 8/1960 | Smith | 108/30 |
| 3,447,489 | 6/1969 | Kagan | 108/30 |

*Primary Examiner*—Roy D. Frazier
*Assistant Examiner*—Peter A. Aschenbrenner
*Attorney, Agent, or Firm*—Howard I. Podell

[57] ABSTRACT

A shelf assembly mountable on a towel bar that is spaced from a vertical wall, which includes a horizontal plate with a peripheral rim; a pair of spaced brackets detachably engaged to the bottom of the plate; the upper part of the brackets being resilient and fitting over the towel bar. An angle bracket is slidably mounted by a screw and wing nut in a slot in the underside of the mid-section of the plate so that a vertical leg of the bracket may be fixed in position to bear against an inside surface of the towel bar when the rear of the plate and the brackets bear against the external vertical surface of a wall to which the towel bar is fixed in spaced relation.

2 Claims, 5 Drawing Figures

SHOWER SHELF

FIELD OF THE INVENTION

This invention relates generally to a bracket and shelf support assembly that is readily mounted against a vertical bathroom wall to rest on a towel bar spaced from the wall.

DESCRIPTION OF THE PRIOR ART

The prior art, as exemplified by U.S. Pat. Nos. 3,865,336; 3,049,273; 3,489,382; 3,437,214; and 3,419,155 is generally illustrative of the pertinent art but the aforementioned patents are non-applicable to the present invention. While the prior art expedients are generally acceptable for their intended purposes only, they have not proven entirely satisfactory in that they are either complex and expensive to manufacture, or bulky and inconvenient to use. As a result of the shortcomings of the prior art, typified by the above, there has developed a substantial need for improvement in this field.

The principal object of this invention is to provide a device or article of readily merchandizable character which combines simplicity, strength and durability in a high degree, together with inexpensiveness of construction owing to a minimum of parts so as to encourage widespread use thereof.

Additional objects and advantages of the invention will be set forth in part in the description which follows and in part will be obvious from the description, or may be realized by practice of the invention, the objects and advantages being realized and attained by means of the instrumentalities and combinations particularly pointed out in the appended claims.

SUMMARY OF THE INVENTION

This invention resides in a shelf assembly mountable on a towel bar that is spaced from a vertical wall, which includes a horizontal plate with a peripheral rim; a pair of spaced brackets detachably engaged to the bottom of the plate; the upper part of the brackets being resilient and fitting over the towel bar. An angle bracket is slidably mounted by a screw and wing nut in a slot in the underside of the mid-section of the plate so that a vertical leg of the bracket may be fixed in position to bear against an inside surface of the towel bar when the rear of the plate and the brackets bear against the external vertical surface of a wall to which the towel bar is fixed in spaced relation.

BRIEF DESCRIPTION OF THE DRAWING

In the accompanying drawing, in which is shown one of the various possible illustrative embodiments of this invention, wherein like reference character identify the same or like parts.

DESCRIPTION OF THE PREFERRED EMBODIMENTS

Figure 1:
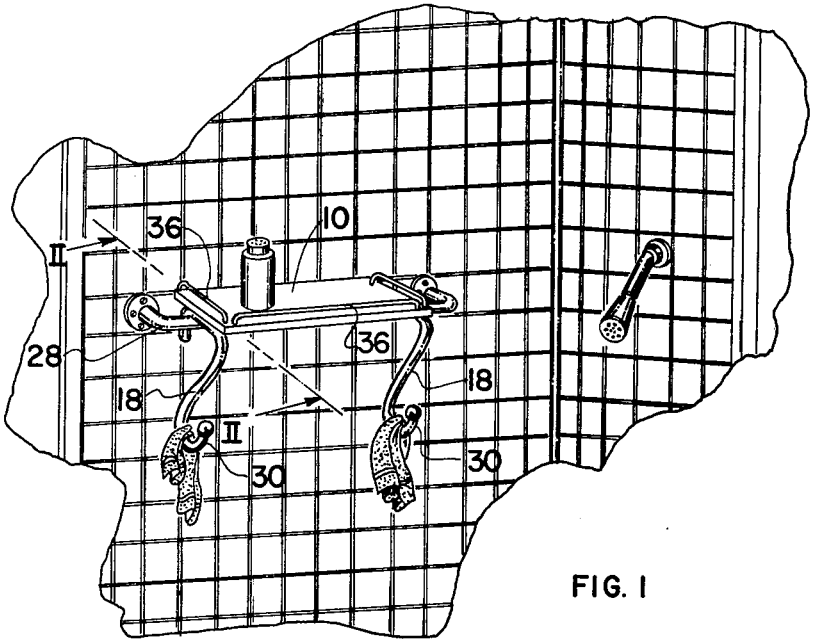
FIG. 1 is a perspective view showing the shelf and bracket assembly of the invention in place.
Figure 5:
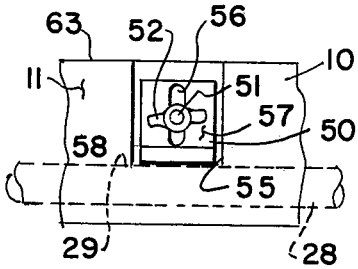
FIG. 5 is a detail bottom view of the mid-section of the shelf.
Figure 2:
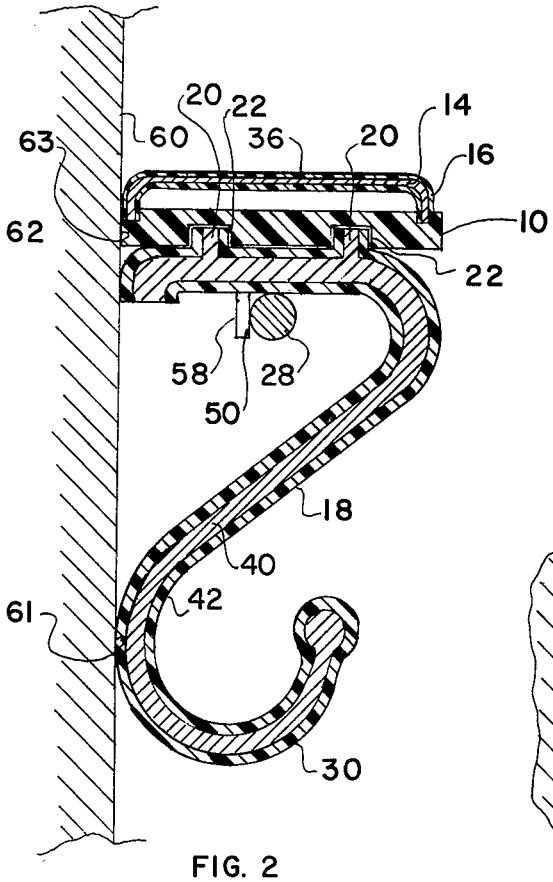
FIG. 2 is a side sectional view of same taken along line II—II of FIG. 1.

Referring now to the drawing, there is shown and illustrated an assembly of the type above described and in accordance with the concept of this invention. The illustrated tangible embodiment of the invention includes a plastic plate 10 which suitably is fourteen inches long, four inches wide and one-half inch deep. A peripheral rim 36 is formed on three sides of the plate and consists of a wire 14 encased in a rubber sleeve 16. Each of a pair of "S" shaped brackets 18 is removably secured to the bottom of plate 10 by means of a pair of bracket projections 20 which each are received in a separate cavity 22 in the plate that extends from the bottom of the plate. Preferably, brackets 18 are seven and one-half inches long and are each formed of a metal core 40 enclosed by a plastic or rubber sleeve 42. The brackets are formed on their bottom as turned hook parts 30 which each measure $2\frac{3}{4}$ inches in width and usefully serve as individual towel holders, as shown in FIG. 1.

Each bracket 18 is formed with a pair of spaced projections 20 extending upwardly from the upper straight horizontal leg section 21, with each projection 20 received in an individual blind cavity 22 in the plate 10 resting on leg section 21. The rear end of each leg section 21 is curved downwards and located so that vertical rear end surface 62 of leg section 21 bears against wall 60 when rear end surface 63 of plate 10 and rear surface 61 of the bottom of hook part 30 also each bear against the wall 60 in the installed position.

An open groove 55 extends from the bottom surface 11 of plate 10 in the mid-section of plate 10 from the rear edge 63, with an angle bracket 50 slidably mounted in groove 55 with a vertical leg section 58 extending downwards so as to bear against the inside surface of a towel bar 28 when the horizontal leg section 57 is fixed in position by tightening wing nut 52 on screw 51. Screw 51 is fixed in plate 10 and extends through a slot 56 in leg section 57. Bracket 50 is preferably formed of rubber covered metal, and is slidable in groove 55 when nut 52 is loosened so that bracket leg 58 may bear against the towel bar, regardless of the exact spacing of the towel bar from wall 60, with the rear edge 63, plate 10 and the rear edges 61, 62 of bracket 18 also bearing against the wall to hold the shelf in position on the towel bar.

Figure 3:
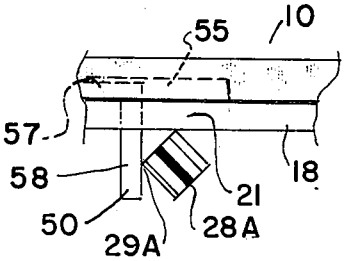
FIG. 3 is a detailed view showing attachment of the bracket to a square towel bar.
Figure 4:
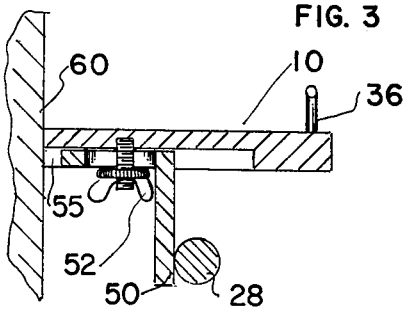
FIG. 4 is a side sectional view taken along line IV—IV of FIG. 1.

FIG. 3 shows that the brackets 18 can be rested on a square towel bar 28A with angle leg 58 bearing against an inside corner 29A of bar 28A.

The operation and use of the invention hereinabove described will be evident to those skilled in the art to which it relates from a consideration of the foregoing.

The present invention is believed to accomplish among others all of the objects and advantages herein set forth.

Without further analyses, the foregoing will so fully reveal the gist of this invention that those skilled in the art can by applying current knowledge thereto readily adapt it for various applications without omitting certain features which can constitute essential characteristics of the generic or specific aspects of this invention. Therefore, a more lengthy description is deemed unnecessary.

It is intended that various changes may be made in this invention in the practical development thereof, if desired. Such changes are comprehended within the meaning and range of equivalency of the following claims. The invention, therefore, is not to be restricted except as is necessitated by the prior art.

Having thus described the invention, what is claimed as new and to be secured by Letters Patent is:

1. A bracket and shelf assembly mountable on a towel bar that is fixed at a spaced distance from a vertical wall, comprising a plate for supporting articles; a pair of spaced brackets in snap fit engagement with the bottom of said plate; said brackets having upper and lower hook portions; said upper hook portions shaped to fit over said bar, together with a clip member extending from the underside of the plate, which clip member, in the installed position of the assembly, bears against a side surface of the towel bar which said side surface faces the external surface of the wall to which the towel bar is mounted.

2. The invention as recited in claim 1 in which the clip member is slidably mounted in relation to the underside of the plate, together with means to fix the clip member in a fixed position with reference to the plate.

* * * * *